United States Patent [19]

Bergmann

[11] 4,138,746

[45] Feb. 13, 1979

[54] FACE SHIELD PROTECTIVE SYSTEM AND APPARATUS

[76] Inventor: Donald W. Bergmann, 811 Bellview, Amarillo, Tex. 79106

[21] Appl. No.: 781,857

[22] Filed: Mar. 28, 1977

[51] Int. Cl.[2] ..... A42B 3/00; A61F 9/02

[52] U.S. Cl. ..... 2/424; 2/10; 2/434

[58] Field of Search ..... 2/10, 9, 206, 424, 434, 2/436, 438, 441, 443, 174; 221/312 A; 206/493

[56] References Cited

U.S. PATENT DOCUMENTS

| | | | |
|---|---|---|---|
| 3,945,044 | 3/1976 | McGee et al. | 2/436 |
| 4,044,890 | 8/1977 | Kramming | 221/312 A |
| 4,047,249 | 9/1977 | Booth | 2/424 X |

FOREIGN PATENT DOCUMENTS

| | | | |
|---|---|---|---|
| 2224121 | 10/1974 | France | 2/438 |

*Primary Examiner*—Peter Nerbun

*Attorney, Agent, or Firm*—Richards, Harris & Medlock

[57] ABSTRACT

For maintaining visibility through transparent protective eye and face shield attached to a helmet a series of like thin transparent auxiliary lenses form a compact series of transparent neighboring sheets, each sheet with grasping ear portions; all sheets except the most peripheral have an extensible tab elastically compressed between a lateral portion of adjacent sheets so that only the most peripheral of the series connected to the shield of the helmet extends laterally whereby a finger hole therein is selectively available for engagement by the operator for rapid and firm removal thereof when the exterior surface of the most exterior of the series becomes muddy, scratched or otherwise damaged.

12 Claims, 18 Drawing Figures

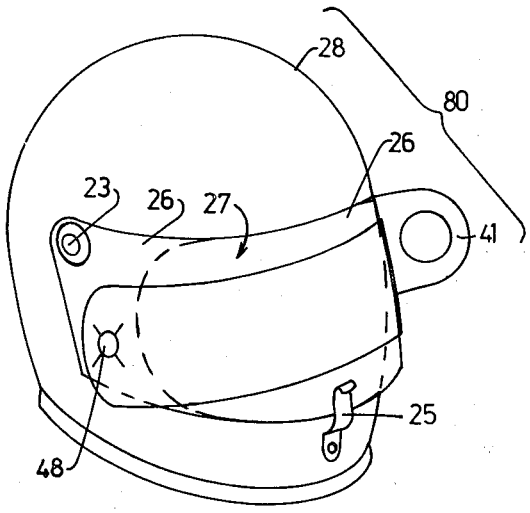
FIG.13
FIG.14
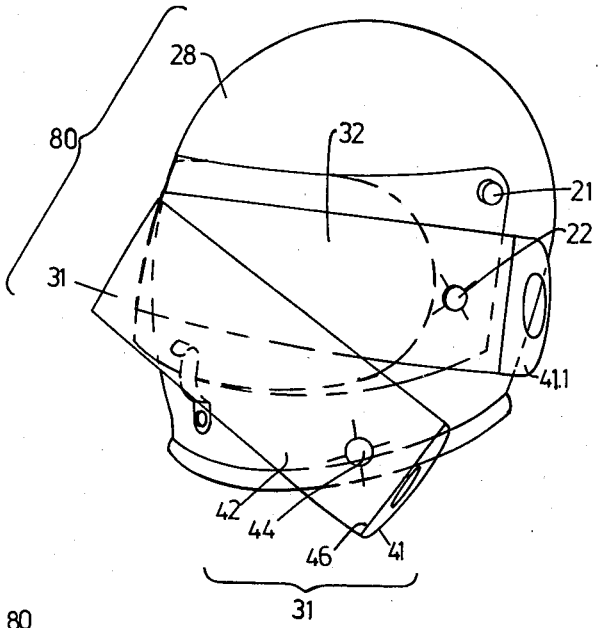
FIG.15
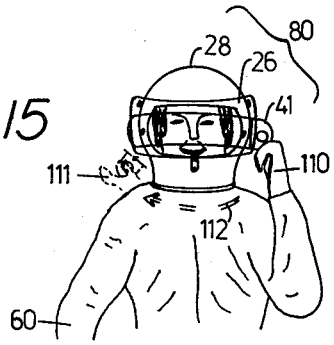

FACE SHIELD PROTECTIVE SYSTEM AND APPARATUS

BACKGROUND OF THE INVENTION

1. THE FIELD OF THE INVENTION

The field of art to which this invention pertains is face shields especially for helmets.

2. DESCRIPTION OF THE PRIOR ART

The prior art of eye and face protection has not provided means for rapid and convenient and repeated removal of matter on the exterior surface of a visor or face shield for practical use during riding a motorcycle in dirty atmosphere although such situations are quite common in motorcycle travel and racing.

SUMMARY OF THE INVENTION

In this system of helmet lenses for motorcycling or other like operations utilizing the disclosed apparatus, the most exterior of a series of like transparent lenses is arranged to be selectively readily removed from a helmet by its wearer so that the apparatus not only provides for supplying sequentially readily rapidly removable surfaces but also, during such removal of any one exterior member of the series, the remaining members of the series provide uninhibited clear visibility and protective covering.

BRIEF DESCRIPTION OF THE DRAWINGS

The terms (a) left and (b) right used herein respectively refer to (a) the left side (whereat are located the referent numerals 20, 30, 60 and 70) and (b) the right side (whereat is located the referent numerals 9A and 41) of a rider shown as 60 wearing a helmet as 20 and supporting apparatus 30 according to this invention. The terms front and rear refers to the front and rear of such rider 60.

FIG. 3 is a view of the front of such apparatus; FIG. 6 is a right side oblique view thereof and FIG. 10 is a left side oblique view of such apparatus.

FIG. 5 is a front view of the apparatus in such position; FIG. 7 is a right side view of the assembled apparatus as shown in FIGS. 3 and 6 after the grasping ear has been removed from its holding button therefor.

FIG. 10 is a left oblique view of the apparatus of FIG. 3 in the position of its parts shown in FIGS. 3 and 6.

FIG. 11 is a left oblique view of the apparatus of FIG. 3 shown in the position of its parts as shown in FIGS. 5 and 7.

FIGS. 13, 14 and 15 show the apparatus of FIGS. 16–18 in another of its operative positions; in the position of FIGS. 13–16 the grasping ear of each of the lenses of the assembly of lenses is extended leftward from the left side of the helmet. FIG. 13 is a oblique view from the right side of the apparatus in the position of its parts where the grasping ear portion of the most exterior of the series of lenses is in leftward extending position. This figure is, generally, a mirror image of the structure shown in FIG. 10.

FIG. 14 is an oblique view from the left side of the apparatus showing the position of its parts wherein the leftward extending grasping ear of the most exterior of the lenses has been removed from the holding button therefore. This corresponds generally to the mirror image of the parts shown in FIG. 11.

FIG. 15 is a diagrammatic front view generally as in the zone 15A—15A of FIG. 8 showing a rider in a stage of moving the most exterior lens of the series of lenses from its position shown in FIG. 13 to the position thereof shown in FIG. 14.

FIG. 18 is drawn to scale. Dimensions of apparatus shown in FIGS. 17 and 18 are set out in Table I (Insert A).

FIGS. 1–3, 5–11, 13 and 14 are pictorial and substantially to the same scale.

TABLE I

Figure 17:
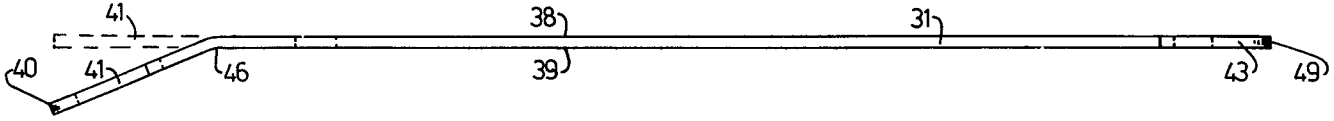
FIG. 17 is a top view of a single one of the lenses in its expanded and bent condition in solid lines.
Figure 18:
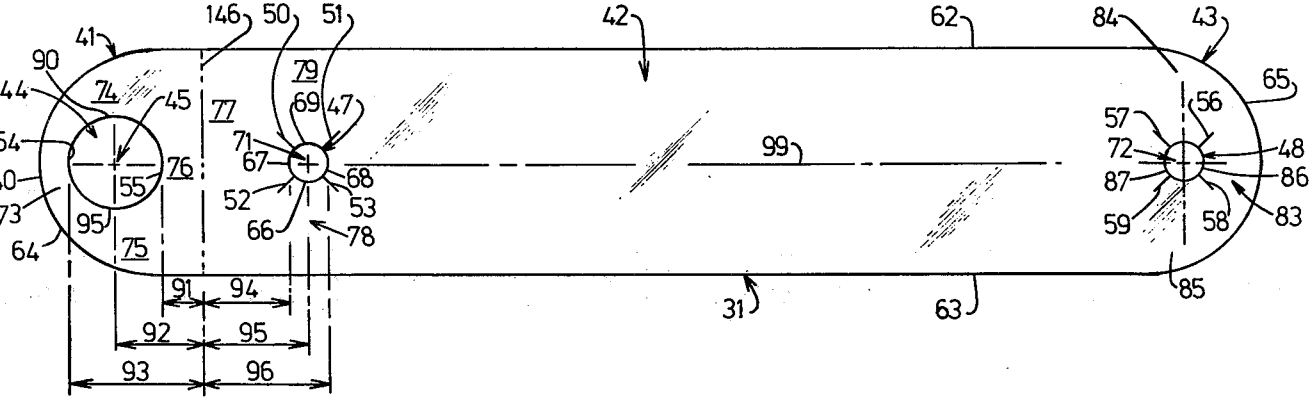
FIG. 18 is a front view of the lens shown in FIG. 16 in its flattened position (shown in dashed lines in FIG. 17).

| DIMENSIONS OF LENS ELEMENT 31 REFERRED TO IN FIGURES 17 and 18 | | |
|---|---|---|
| DIMENSIONS AND DISTANCES | CENTIMETERS | INCHES |
| 91 | 1.59 cm. | 5/8 in. |
| 92 | 3.2 cm. | 1-1/4 in. |
| 93 | 4.8 cm. | 1-7/8 in. |
| 94 | 2.5 cm. | 1 in. |
| 95 | 3.2 cm. | 1-1/4 in. |
| 96 | 3.8 cm. | 1-1/2 in. |
| 40 to 146 | 5.9 cm. | 2-5/16 in. |
| 99 to 63 | 3.8 cm. | 1-1/2 in. |
| 62 to 63 | 7.6 cm. | 3 in. |
| 54 to 55 | 3.2 cm. | 1-1/4 in. |
| 57 | .60 cm. | 1/4 in. |
| 40 to 49 | 40.8 cm. | 16 in. |
| 87 to 86 | 1.25 cm. | 1/2 in. |
| 71 to 72 | 29.2 cm. | 11-1/2 in. |
| 72 to 49 | 2.4 cm. | 15/16 in. |
| 38 to 39 | .0127 cm. | 1/200 in. |

DESCRIPTION OF THE PREFERRED EMBODIMENT

The apparatus 80 of the invention comprises the helmet 20, shield 26, and the assembly 30.

The motorcycle rider's helmet 20 comprises a rigid shell 28 on which are firmly mounted a plurality of rigid shield fasteners 21 & 23. Fasteners 21 and 23 provide for pivotal connection of a transparent imperforate shield 26 to the shell 28 and over the front opening 27 in helmet 20.

A bottom center shield latch 25 is firmly yet pivotally attached at the shell 28 and holds the shield 26 in position over the opening 27.

Figure 1:
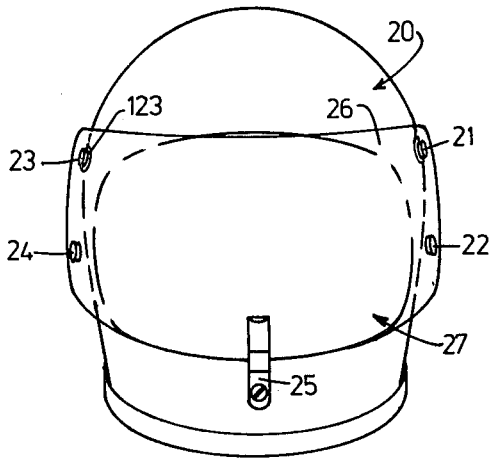
FIG. 1 shows a safety helmet and a base shield thereon as seen from the front thereof prior to additions thereto of the removable lenses shown in FIGS. 16–18.
Figure 2:
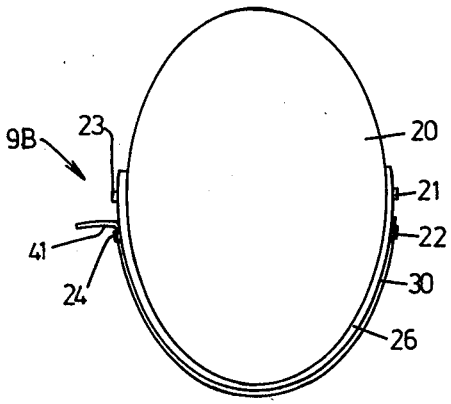
FIG. 2 is a top view of the apparatus shown in FIG. 3 as seen along direction of arrow 2A of FIG. 3.
Figure 12:
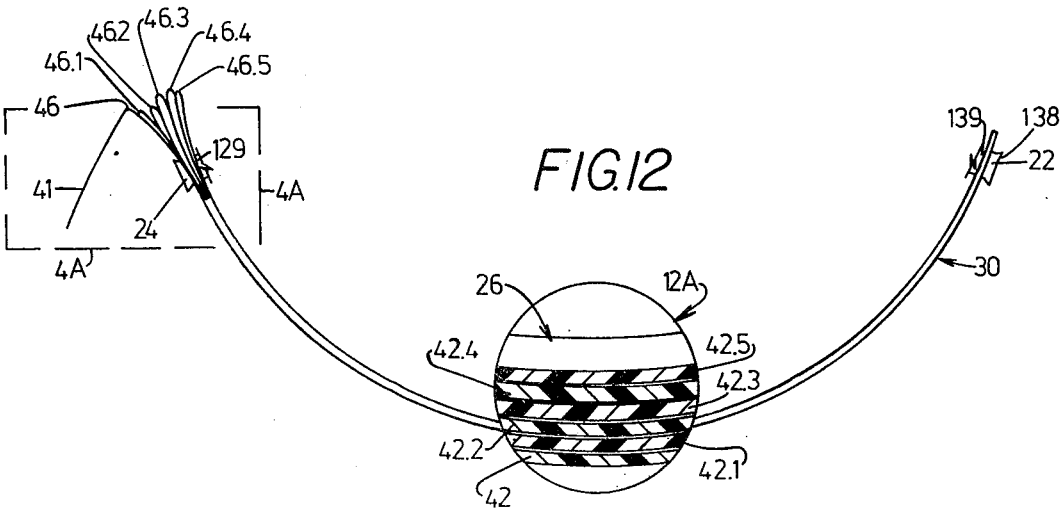
FIG. 12 is a diagrammatic sectional view of the curved assembly of the series of lenses of FIG. 16 after taken from the package 37 and assembled and positioned as shown in FIGS. 3, 6 and 10. A portion thereof (12A) is shown enlarged to better show details in that portion.

A series 30 of several like generally flat bent lenses 31, 32, 33, 34, 35 and 36 are stored or provided in a transparent and storage package therefore 37; in its operative position, the assembly 30 comprises a series of like lenses 31–36 which is supported in a curved form, as shown in FIGS. 2 and 12, in particular, by the fasteners 22 and 24 in firm contact with the outside surface of the shield 26 for serial removal of such lenses, one at a time, from such assembly. The assembly 30 may be arrayed with each of a series of grasping ears as 41 and 41.1–41.5 located on the right side of the helmet 20 or, as shown in FIGS. 13 and 14, on the left side of the helmet. When the ears as 41 and 41.1–41.5 are located on the left or right side each ear as 41 serves to provide that a rider as 60 on a motorbike as 70 may, by a horizontal pull, remove each of those members of the series one at a time as needed while riding and, automatically, be provided with protection of the shield and a disposable lens immediately after as well as during such removal of each of the outermost of the series of lenses.

The overall apparatus 80 comprising the helmet 20, lens 26 and assembly 30 are arranged so that the bike rider 60 pulls each lens as 31 laterally and horizontally; this avoids any downward pull as might affect the balance of the helmet 20 or the rider 60 wearing such helmet.

Each of the lenses as 31–36 is similar to the others of the group; accordingly the description of the one given herein in some detail, 31, is the same for all the others 32–36.

Figure 6:
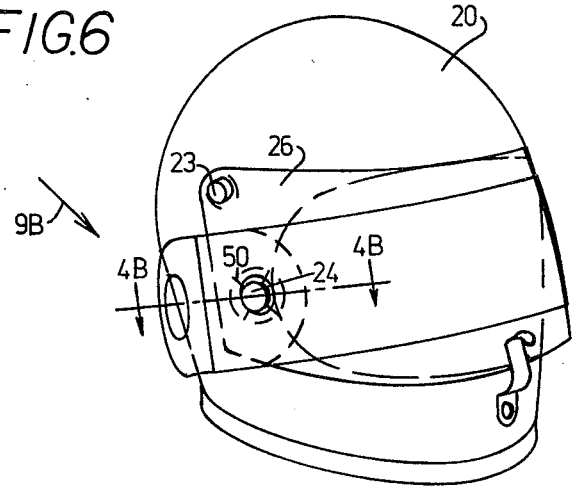
Figure 7:
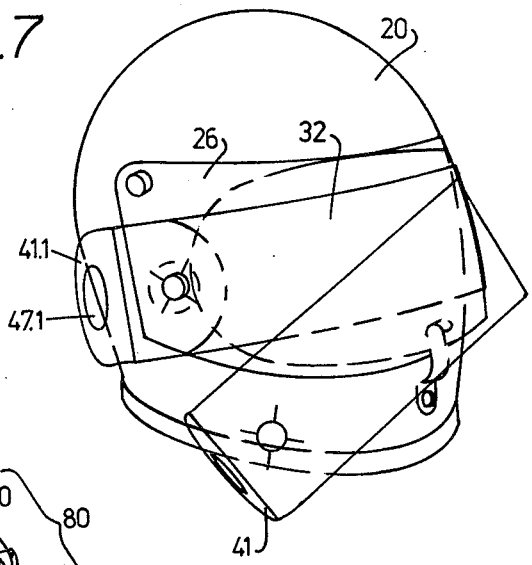
Figure 8:
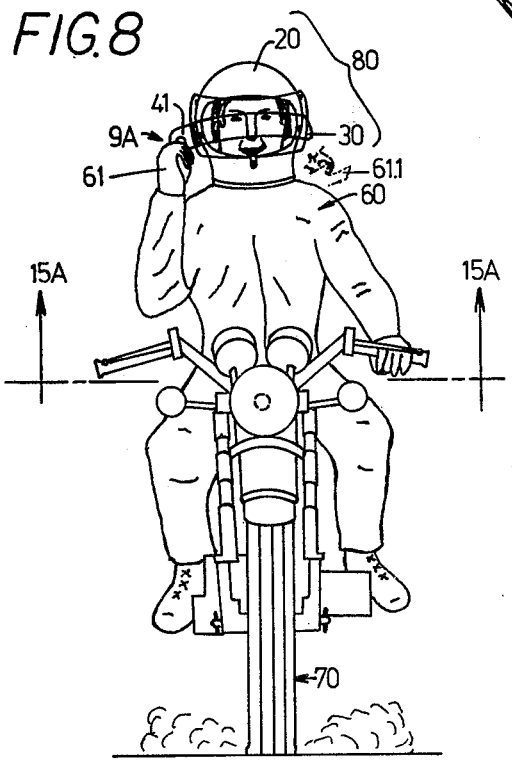
FIG. 8 is a front view of a rider in a stage of moving the most exterior lens of the lenses of a series thereof as in FIG. 12 from its position shown in FIG. 3 to the position thereof shown in FIGS. 7 and 11.
Figure 9:
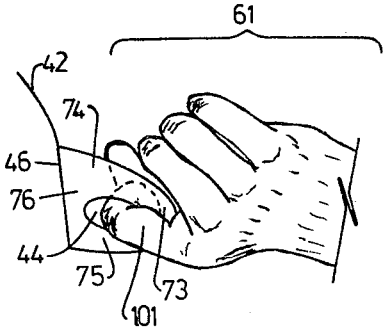
FIG. 9 is a rear oblique view of a zone as 9A in FIG. 8 as seen along direction of arrow 9B of FIGS. 2 and 6.

Lens 31 is formed of a transparent relatively flexible yet dimensionally stable sheet which is comprised, as shown particularly in FIGS. 17 AND 18 and, also, in the embodiment array of FIGS. 2–12, of a right (as shown in FIG. 8) or grasping ear portion 41, a central lens portion 42 and a follower end portion 43, all joined together.

The lens 31 has a grasping edge 40 at the peripheral right edge (the right as shown in FIG. 8) of the grasping ear portion 41 of the lens; portion 41 is continuous with and adjacent to the central lens portion 42 which is continuous with the follower end portion 43 which has, at left side as shown in FIGS. 8 and 17 and 18 a follower edge 49. The outline 64 of the grasping ear portion 41 is generally semicircularly shaped and has at the approximate middle thereof a circular grasping ear hole 44. The peripheral, or rightward, as shown in FIG. 8, edge 54 of the circular grasping ear hole 44 is spaced away by a relatively small but significant mass 73 of the lens body, from the right hand or grasping edge 40 of the lens 31. The center 45 of the circular hole 44 is indicated by intersection of the dashed diametral lines in the circular hole 44, the vertical one of which is contacted by the arrow leading from the referent numeral 92 and the horizontal one of which is co-linear with the central line 99.

A permanent straight fold 46 is located between the grasping ear portion 41 of the lens and the central portion 42 of the lens and separates those portions for purpose of description although the sheet is continuous across the fold 46 and the fold does not weaken the sheet for its function as used herein leftward (as shown in FIGS. 3, 5, 6 and 7. In the operative position of the apparatus shown in FIGS. 3–8 is located a slotted circular grasping end fastener hole 47 which is circular. A follower end portion slotted circular fastener hole 48 is located near to but spaced away from the curved edge 65, which extends to the lateral follower end edge 49 of the lens 31 and that hole 48 is located in the follower end portion 43 of the lens 31.

A plurality of angularly equispaced slits 50–53 extend radially equidistantly from the center 71 of the grasping end fastener hole 47 into the sheet forming the center lens portion 42. These slits are a top outer slit 50, a top inner slit 51, a bottom outer slit 52, and a bottom inner slit 53. Similarly, the circular follower end lens hole 48 has, radially equispaced spaced and extending radially from its center, 72, hole 48 a follower end lens hole top outer slit 56, top inner slit 57, bottom outer slit 58 and bottom inner slit 59. The slits 56–59 are all of the same length and size and the same length and size as the slits 50–53.

Figure 16:
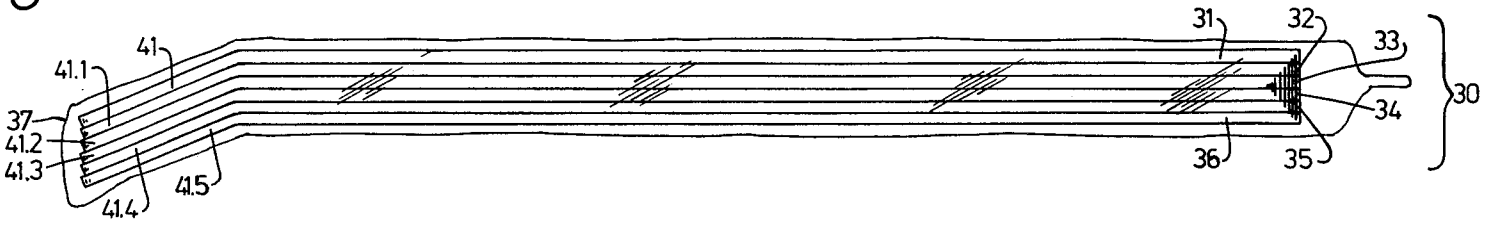
FIG. 16 is a top view of a package of lenses according to this invention.

A grasping ear peripheral portion 73 is located between the peripheral hole edge 54 and the lateral edge 40 of the grasping ear portion 41 of the lens 31. A grasping ear upper portion 74 is continuous with the grasping ear peripheral portion 73 above hole 44 as shown in FIG. 16 and continuous therewith and extends to the fold 46.

A grasping ear peripheral bottom portion 75 extends from the bottom portion of the grasping ear peripheral portion 73 to the fold 46. The portion 74 is located above the hole 44; the portion 73 is located lateral of the lateral edge 54 of the hole 44 and the bottom portion 75 is located below the hole 44 and between the central edge 55 of the hole 44 and the lateral 54 of that hole 44. A central portion 76 of the grasping ear portion of the lens is located between the fold 46 and the central edge 55 of the hole 44. That central portion 76 is continuous at its bottom with the lower portion 75 and the upper portion 74 of the grasping ear portion. Portion 76 is also continuous at its central edge, i.e. at the fold 46 with the lateral segment 77 of the central portion 42 of the lens.

A lateral segment 83 of the follower end portion 43 is located adjacent to and peripheral of the lateral edge 86 of the hole 48; a lower segment 85 of the follower end portion 43 is located below the hole 48 and is continuous with the lateral segment 83; an upper segment 84 of the follower end portion 43 is located above the hole 48 and is continuous on its lateral side or end with the lateral segment 83. The portions 84 and 85 extend from the inner edge 87 of the hole 48 to the outer edge 86 of that hole. The segments 84 and 85 are continuous at their central portions with the central portion 42 of the lens 41. The peripheral curved edges 65 and 64 of the follower end portions and the grasping end portions respectively, are continuous with the top edge 62 and bottom edge 63 of the central portion 42; on the right side of portion 42 a lower lateral segment 78 located below fastener hole 47, as shown in FIG. 18, is continuous at its lateral end with a lateral sheet segment 77 of the central portion 42 and, above hole 47 (as shown in FIG. 18) an upper lateral segment 79 of central portion 42 is continuous at its lateral end with the central end of the lateral sheet segment 77. Portions 78 and 79 are continuous at their central (rightward as shown in FIG. 18) portion of the lens 31 with central portion 42 and portions 76 and 77 are continuous with each other across the fold 46. The line 146 at the center of the straight fold 46 is referred to as the fold line and measurements below referred to are made from such fold line for purpose of comparison.

The distance 91 (shown in FIG. 18) from the fold line 146 to the inner edge 55 of the hole 44 is less than the distance 94 from the fold line 46 to the lateral edge 67 of the hole 47.

The distance 92 from the fold line 146 to the center 45 of the hole 44 is the same as the distance 95 from the fold line 146 to the center of hole 47. The distance 93 from fold line 146 to outer edge 54 of the hole 44 is greater than the distance 96 from the fold line 146 to the central edge 68 of the hole 47.

A straight line 99 extends through the center of holes 47, 44, and 48; this line 99 provides an axis of those holes. The distance of point 90, the upper edge of hole 44, from line 99 is greater than the distance of point 69 of hole 47: also, the distance of the point 95 on the bottom edge of hole 44 below line 99 is greater than the distance of point 66 from line 99. Points 69 and 66 are, respectively, the top and bottom edges of hole 47.

The edges 62 and 63 are equidistant from and parallel to the axial line or central line 99.

The fastener 24 comprises a female snap member 29 and a male base member 130. Member 29 is fixed to member 130 and member 130 is fixed to the shield 26 on helmet 20. Member 29 comprises a rigid wide shoulder 128 on a cylindrical rigid shaft 129; shaft 129 is attached to a sleeve 125. The sleeve 125 is rigid and firmly held in a hole 127 in the shield 26. The relatively wide shoulder 128 serves as a base for engaging and holding edges as 67 of the grasping end fastener holes as 47 and 47.2 of each of the lenses as 31–36 on shaft 129. Shaft 129 has an outside diameter which is larger than the diameter of each of hole 127 and sleeve 125. The sleeve 129 is hollow and provided with an internal collar to provide for entry of and engagement with a free tee-shaped end of 125 as a male snap thereinto. The base 126 of member 125 is firmly attached to the shield 26.

The fastener 22 comprises a female snap member as 29 and a male base member as 130 with such member as 29 of fastener 22 fixed to shield 26 and member as 30 fixed to the shell 28 of helmet 20.

Figure 10:
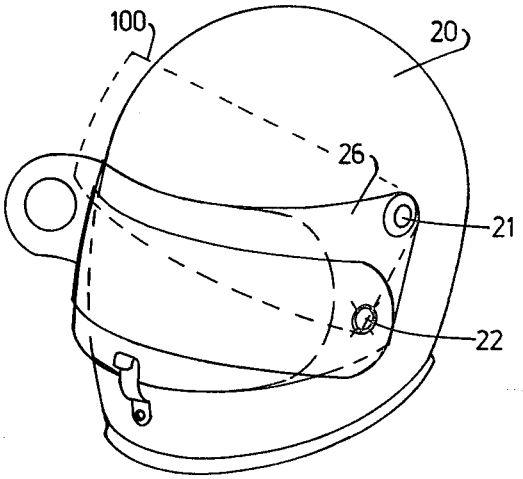

On release of fastener 25 from shield 26 the shield 26 may be rotated about fasteners 21 and 23 from the position shown in full lines in FIG. 6 to the position thereof shown in FIG. 10 in dashed lines and indicated by the referent numeral 100.

Button or fastener 24, like button or fastener 22 is sufficiently large so that an adult finger may comfortably grasp the shoulder as 128 of button 24 (and similar shoulder 138 on button or fastener 22) to move those buttons and the shield 26 to which those buttons are attached. There is a small but definite space of about 1/16" between the shoulder 128 and 138 of the buttons 22 and 24 and the adjacent outer surface of the shield 26. This space is the distance traversed by the shaft 129 and 139 of the buttons 22 and 24 and this length of such shaft provides for attachment of the lenses 31–36 thereon.

Figure 4:
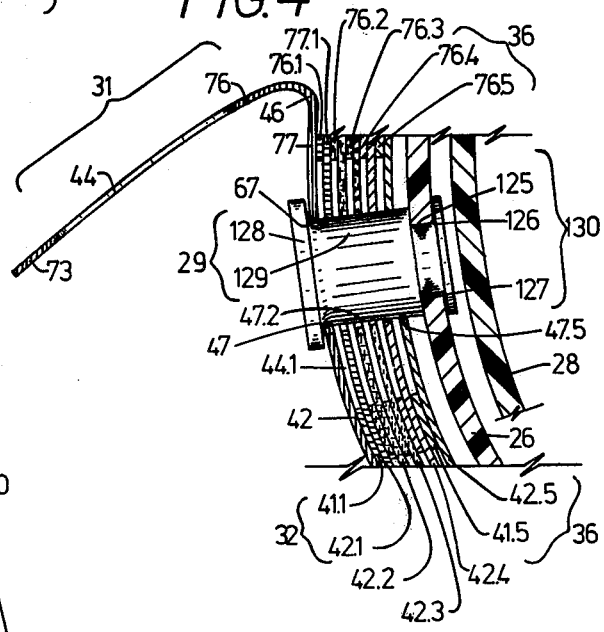
FIG. 4 is an enlarged diagrammatic transverse view of zone 4A in FIG. 12 along section 4B—4B of FIG. 6.

The parts of the like elements of lenses 32, 33, 34, 35 and 36 correspond to the like or identical parts of the lens 31 above discussed, e.g. parts of elements or lenses 32–36 which correspond to the grasping ear portion 41, in particular, of element 31 are shown as 41.1, 41.2, 41.3, 41.4 and 41.5 respectively; generally, corresponding parts of the element or lenses 32–36 are given referent numerals and referred to in this text with the same principal referent numerals as used for element or lens 31 followed by a decimal point and a terminal digit as 0.1–0.5 (as in 41.1–41.5) respectively for similar like parts in elements 32–36 corresponding to the similar like parts of element 31, as shown in FIGS. 4 and 12.

Prior to location of each element of the series assembly 30 in position as shown in FIGS. 3 and 6 or 10 and 13, element 31 is folded about its fold line as 146 until the center 45 of the grasping ear hole 44 is adjacent to the center of the hole 47 and the hole outline of the hole 44 is concentric with the outline of the hole 47. At this point the center line 99 also passes through the center 45 of the hole 44.

Each element 32–36 is folded about a fold as 46.1–46.5 until the center of the hole as 44 thereof is adjacent to the center of the hole as 47 and the hole outline of the hole as 44 is concentric with the outline of the hole 47. At this point the center line 99 also passes through the center 45 of the hole 44, as shown in FIG. 4; the outside radius of curvature of each of fold 46.1–46.5 is about 0.5 mm and from 0.3–0.7 mm for sheet that is 0.2 mm thick.

Whereupon the follower end hole of element 36 corresponding to hole 48 of element 31 is placed over a shoulder 138 on the shaft 139 (corresponding to collar 128 and shaft 129 on fastener 24) of fastener 22 by a resilient bending of the portion of segment or areas of element 36 corresponding to segment 83 adjacent hole as 48 between slits as 56 and 58 of element 31, and area or segment as 84 adjacent hole as 48 between slits as 56 and 57, area or segment as 87 adjacent hole as 48 between slits as 57 and 59 and area or segment as 85 adjacent hole as 48 between slits as 58 and 59. Thereafter the hole 47.5 of element as 36, corresponding to hole 47 of element 31, is, by a resilient bending of the portion of element 36 corresponding to segment 78 of element 31 adjacent hole as 47 between slits in element 36 corresponding to slits 52 and 53 in element 31 and by resilient bending of the portions of element 36 corresponding to the segments 77 and 79 adjacent hole 47 of element 31 between slits of element 36 corresponding to slits 52 and 50 of element 31 and 50 and 51 respectively and also, by resilient bending of the portion of element 36 corresponding to the portion of element 31 adjacent to hole 47 adjacent to slits as 51 and 53 in element 31, pressed past the shoulder or collar 128 of fastener 24 and located on shaft 129 of fastener 24 as shown in FIG. 4. The hole in element 36 corresponding to hole 47 forms a firm yet slidable fit on the shaft 129. The ear portion 41.5 of element 36 is folded about fold 46.5 of element 36, as shown in FIG. 12, so that the grasping hole 47.5 thereof corresponding to the hole 47 of the element 31 is located adjacent to the lateral portion of the center portion 42.5 as shown in FIG. 4. This folding and location of each of the elements as 36 on fasteners 22 and 24 is followed one at a time for each of elements 35, 34, 33 and 32 is repeated so that each of the series of lenses as 32–36 is folded with the ear or flap therefor, as 41.1–41.5 respectively, on the outer side of the central portion thereof, as 42.5–42.1, as shown in FIG. 4.

The most peripheral lens, 31, is located as above described for lens 36 with its follower hole 47 on the shaft 139 of the button 22 and its grasping end lens hole 47 similarly attached to the shaft 129 of the fastener 24. As the shoulder 128 extends with a greater diameter than the shaft 129 it serves to hold the lenses 31–36 in place generally as shown in FIG. 4.

Figure 3:
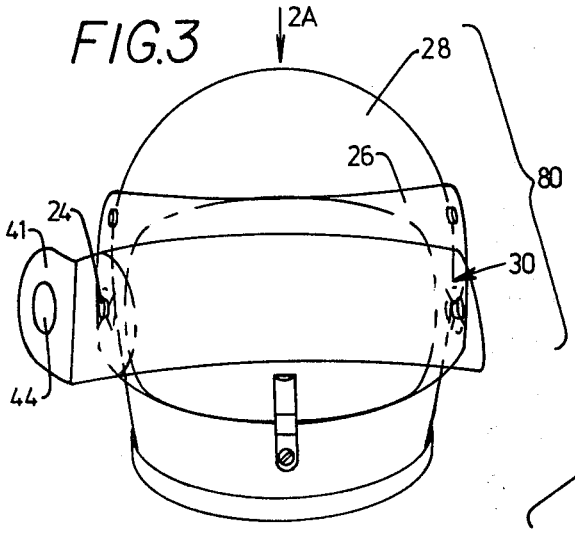
FIGS. 3, 6 and 10 are different views all of which show the apparatus of this invention in the same one of its operative positions with the grasping ear of the most exterior of the series of lenses shown in its rightward extended position.

The grasping ear 41 of the lens 31 however, it not held against the portion 42 of lens 31 but extends laterally outward as shown in FIGS. 3 and 4. Thereby, by an overall array is formed comprising a plurality of adjacent lenses 31–36 whose portions as 42 and 42.1–42.5 are, as shown in FIG. 12 adjacent to each other and shield 26 and whose portions adjacent to fastener 24 are, as shown in FIG. 4 located with the grasping ear portion as 76.1 folded and located outboard of the lateral portion as 77.1 of each of the lenses 32–36 and inboard of the adjacent lens element, as 77 which is exterior thereof (for all elements except the most exterior, 31, thereof); for the most exterior element of the group, 31, the grasping ear portion 41 extends laterally as shown in FIGS. 3, 4, 6 and 10.

Each of the lenses 31–36 is thus attached at a hole as 47 to the shaft 129 on the fastener 24 and drawn around and held adjacent to the front of the shield 26 and attached at its hole such as 48 to the shaft 139 on the fastener 22. Fastener 22 is held to shield 26 firmly as is fastener 24.

The overall structure 80 resulting from the attachment of the series of lenses, 30, to shield 26 and the helmet 20, provides, as shown in FIGS. 2, 3 and 13 an array of transparent like auxiliary lenses or shields 32–36 with a peripheral auxiliary shield 31 and the base shield 26. The array of lenses 31–36 is held on the shield 26 for selective and rapid removal of the peripheral member of the assembly because the hole 44 at 1¼" diameter of each element as 31 is substantially larger than the diameter of the ⅝ inch shoulder 128 of the fastener 24 although each ½ inch diameter hole as 47 and 48 at the grasping end and follower end of the central (42) portion of each lens as 31 has diameter larger than the shaft as 129 and 139 and smaller than the shoulder 128 and 138 respectively; accordingly, the holes as 47 and 148 are sized to a diameter insufficient, in view of the stiffness of the undeformed segment as 68 and 87 adjacent the slits as 50–53 and 56–59 to permit passage of the lens element 31 and other elements 32–36 held as shown in FIG. 4 and above discussed (rightward as shown in FIG. 4) past the shoulder 128. As the shafts 129 and 139 extend in substantially parallel directions, as is shown in FIG. 2, and the lenses 31–36 have a finite although slight thickness the most peripheral lens of the assembly as 31 in the array shown in FIGS. 3, 6, 10 and 13 has a slight compression effect (about 1/32" for the thickness of all of elements 31–36) on the members as 32–36 internal thereto.

The lenses as 31–36 each have corresponding central portions as 42 and 42.1–42.5 as shown in FIG. 12 at the front portion of assembly 30 in the position thereof as shown in FIGS. 3, 6 and 10; those portions of those lenses are in direct surface-to-surface contact with each other with no space therebetween for 9 of the 11½ inches between holes as 47 and 48 in lens 31 (and the like holes in lens elements 32–36) as far as any optical measure is visible to the naked eye to measure any such spacing or effect of such spacing if it exists. The grasping ear portion as 41, 41.1, 41.2, 41.3, 41.4, and 41.5 of each of the lenses as 31, 32, 33, 34, 35, and 36 respectively is located lateral of the central lens portions as 42.1, 42.2, 42.3, 42.4 and 42.5 of each such lens as is shown in FIG. 4.

Figure 5:
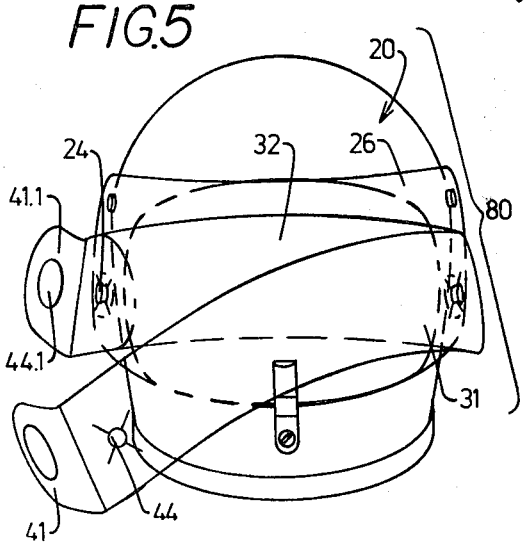
FIGS. 5, 7 and 11 are different views of the same position of the lenses of the series of lenses after grasping of rightward extending grasping ear of the most exterior lens of such series and removing the grasping ear portion of that lense from the holding button therefor.

The resilient compression state of the grasping ear portions created by folding the elements as shown in FIGS. 4 and 12 and above described provides that, on removal of each or any one of the lenses as 31 from its peripheral position shown in FIGS. 3 and 4 to the position shown in FIG. 5 the next ear as 41.1 of the next lens, as 32 in FIG. 4, assumes as shown in FIGS. 5 and 7, the laterally extended position theretofore exhibited by the lens as 31 theretofore lateral thereof (as shown in FIGS. 3 and 4). FIG. 5 shows the apparatus 80 with lens 31 moved laterally after being removed from fastener 24 and the next lens 32 with its ear 41.1 extended. The same array of parts of assembly 80 is shown in FIGS. 7 and 11 and the same selective action of laterally extending and grasping ears as 41 and 41.1 of the most peripheral of the lenses occurs when holes 47 and 47.1–47.5 are located on fastener 22 as shown in FIG. 14.

In the arrangement of parts shown in FIGS. 3, 6 and 10 and also shown in FIG. 13 for 9 inches of the 11½ inch distance between centers, light absorption through the full six-layer thickness of lenses 31–36 of assembly 30 is insignificant in view of the usual bright or good lighting conditions in which motorcycles are used; the lenses are made of smooth vinyl acetate substantially fully (e.g. 95% or more) transparent which by transmission and reflection causes no visible color change, as tested by a standard 7 inch Kodak® Color Control Patch (available in Kodak® Color Separation Guides and Gray Scale, Kodak Publication No. 8-13 of Eastman Kodak Co., Rochester, N.Y.) e.g. when the light reading through 6 lenses 31–36 is, for 100 ASA film, f8 at 1/125 sec. it is, for the same 100 ASA film f/8 at 1/250 second when the same light meter is aimed at the same light source and the light reading is made without the light passing through the six-layer thickness of assembly 30.

In operation an operator as 60 while riding a motorcycle as 70 may raise his right hand, as shown in FIG. 8 and, while watching the roadway to his or her front, pass a finger as 101 of his right hand 61 into the grasping ear hole as 44 and thereby selectively pull the ear 41 of the peripheral lens 31 laterally to the right side and so overcome the force of engagement with which the portion 42 of lens 31 adjacent hole 47 and slits 50–53 contacted the shaft 129 and collar 128 of fastener 24 and also thereby concurrently cause the theretofore resiliently bent ear 41.1 to extend laterally as shown at FIGS. 5 and 7.

Figure 11:
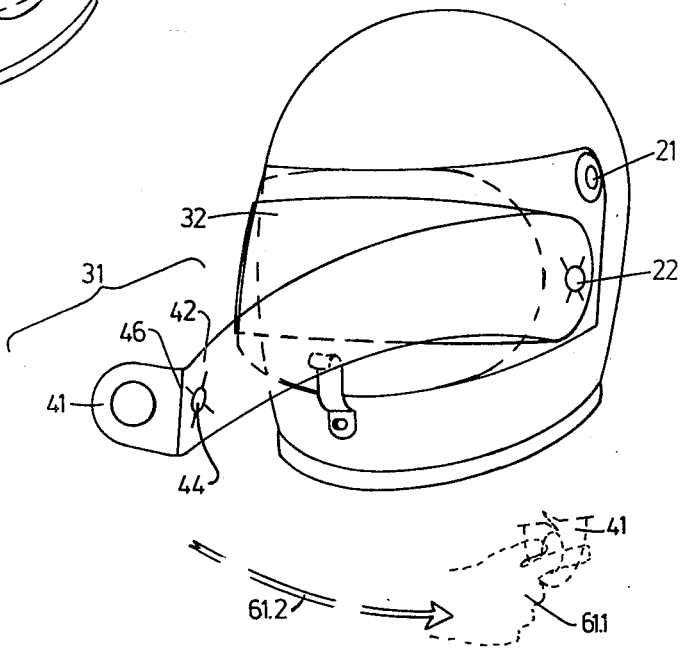

The rider 60, while still holding hole 44 of the ear 41 then moves his right hand 61 toward his left shoulder-,—as shown by direction of arrow 61.2 in FIG. 11—to the dotted line position 61.1 shown for hand 61 in FIG. 11 and thereby enlarges the holes 48 by bending the portions as 83, 84 and 85 of portion 42 of lens 31 adjacent slits 56–59 near hole 48, to release lens 31 from its attachment to fastener 22. While such release of a damaged or dirtied lens 31 is being removed from its attachment to shield 26 (also a transparent plastic, as methyl methacrylate about 0.05 inch thick) the lens 32 theretofore below lens 31 is maintained in operative position for protecting the shield 26 and also provide a laterally extending ear, 41.1, for subsequent ready engagement by the rider for rapid removal thereof from the shield 26. Thereby each exterior, as 31 then 32, of a series of like transparent lenses as 31–36 is arranged to be selectively readily removed from a helmet as 20 by its wearer as 60 so that the apparatus 80 not only provides for supplying sequentially readily rapidly removable surfaces but also, during such removal of any one exterior member as 31 of the series 31–36 the remaining members of the series as 32–36 provide uninhibited clear visibility and protective covering for the shield 26 and so maintain visibility through the transparent protective eye and face shield 26 attached to helmet 20 by the remaining like thin transparent auxiliary lenses of the assembly 30.

The same action above described for removal of the exterior lens 31 by the right hand 61 of a driver 60 also applies when the ears as 41 and 41.1–41.5 of assembly 30 are located on the left side of the helmet 20 as shown in FIG. 15 and a finger of the left hand 110 of the driver 60 is used to selectively remove, one at a time the outermost of the series of elements as 31–36 from the assembly 30 held on the helmet 20 by movement of the rider's left hand 110 to engage the laterally extending ear 41 and then move that hand to the right e.g., to the position shown as 111 in FIG. 15 to remove the lens 31 from helmet 20 while the next lens, as 32 is brought to operating position; as shown in FIG. 14. Such removal of lens 31, as in the operation above described in regard to FIGS. 5, 7, 8, 9 and 11 and diagrammatically indicated by arrow 61.2 on FIG. 11 and arrow 112 in FIG. 15 is usually completed within one second.

The helmet 28 and shield 26 are standard items [as are shown at page 163 of Catalog No. 354B of J. C. Whitney Co., 1976 1917–1919 Archer Avenue, Chicago Illinois.] Fasteners as 22 and 24 are readily firmly located on a variety of helmet face shields as 26 having surfaces as 26 generated by moving a straight line in C-shaped or U-shaped paths transverse to the direction of such straight lines; the assembly 30 is located on such fastener as above described and a large variety of helmets may be used with assembly 30. When assembled and used as above described assembly 30, in an apparatus as 80, not only protects the face shield mechanically but provides for, during motorcycle operation and use by the rider thereof, repeated rapid clearing of deposits that would otherwise accumulate on the face shield of a motorcycle rider, such as dirt, grease, mud and dirty water. The use of assembly 30 on an apparatus as 80 thus avoids permanent creasing or scratching of the face shield as 26 as might occur due to scratching or abrasive action thereon by dirt and dust as is common during riding motorcycles on unpaved roads and in dusty or gritty atmosphere, and so interfere with the driver's operation of the motorcycle. The slits 50–53 and 56–59 extend at an angle of 45° to the line 99 as shown in FIG. 18; this provides for the resilient resistance of the portions of lens 31 between such slits and adjacent to holes 47 and 48 to deformation whereby lenses 31–36 are reliably held on shafts as 129 and 139 yet readily removed from those shafts by laterally pulling on the tabs as 41 as above described.

I claim:

1. A face shield protective apparatus for a helmet with a face shield, said face shield having spaced apart projections extending therefrom, said apparatus comprising a series of like thin transparent auxiliary lenses in a compact series of flexible transparent neighboring sheets attached to said face shield at horizontally spaced apart lateral portions of said sheets and comprising a series of internal sheets and a peripheral sheet, each sheet with a grasping ear portion; each sheet having spaced holes formed therein for receiving the projections of the face shield and a grasping hole formed in the grasping ear portion; all said sheets except the peripheral one having its grasping ear portion elastically compressed between lateral portions of adjacent sheets with the grasping hole of the sheet receiving the adjacent face shield projection, only the most peripheral of said series having its grasping ear portion extending laterally thereform whereby it is selectively available for engagement by an operator for rapid removal thereof.

2. A face shield protective apparatus for a helmet with a face shield, said apparatus comprising series of like thin transparent auxiliary lenses in a compact series of flexible transparent neighboring sheets attached to said face shield at horizontally spaced apart lateral portions of said sheets and comprising a series of internal sheets and a peripheral sheet, each sheet with a grasping ear poriton; all said sheets except the peripheral one having its grasping ear portion elastically compressed between lateral portions of adjacent sheets, only the most peripheral of said series having its grasping ear portions extending laterally therefrom whereby it is selectively available for engagement by an operator for rapid removal thereof;

said lens being formed of a transparent relatively flexible yet dimensionally stable sheet comprised of a right or grasping ear portion, a central lens portion and a follower end portion, all joined together, and said lens having a grasping edge at the peripheral right edge of the grasping ear portion of the lens; said grasping ear portion being continuous with and adjacent to the central lens portion which is continuous with the follower end portion which has a follower edge, the outline of the grasping ear portion being generally semicircularly shaped and having at the approximate middle thereof a first circular grasping ear hole, the rightward edge of the circular grasping ear hole spaced away by a relatively small mass of the lens from the right hand or grasping edge of said lens, said lens follower edge being spaced away from said grasping edge, a permanent straight fold located between the grasping ear portion of the lens and the central portion of the lens and said sheet is continuous across said fold and, leftward of said fold there is located a second slotted circular grasping end fastener hole; and a third follower end portion slotted circular fastener hole is located in the follower end portion of the lens near to but spaced away from the follower end edge of the lens and said second and third holes are spaced apart from each other, a plurality of slits extend radially from the edge of said second grasping end fastener hole into the sheet forming the center lens portion, and a plurality of slits extend radially from the edge of the third follower end fastener hole into the sheet forming the central lens portion and the diameter of said second hole is less than the diameter of said first hole.

3. Apparatus as in claim 2 wherein the centers of said first and second and third holes lie in the same straight line and the slits extend at an angle to said line.

4. Apparatus as in claim 3 wherein the diameters of the second and third holes are the same size.

5. A head and face protecting apparatus comprising a helmet, a face shield attached to said helmet, said face shield having spaced apart projections extending therefrom, and a series of like thin transparent auxiliary lenses in a compact series of flexible transparent neighboring sheets attached to said face shield at horizontally spaced apart lateral portions of said sheets and comprising a series of internal sheets and a peripheral sheet, each sheet with a grasping ear portion; each sheet having spaced holes formed therein for receiving the projections of the face shield and a grasping hole formed in the grasping ear portion; all said sheets except the peripheral one having its grasping ear portion elastically compressed between lateral portions of adjacent sheets with the grasping hole of the sheet receiving the adjacent face shield projection, only the most peripheral of said series having its grasping ear portion extending laterally therefrom whereby it is selectively available for engagement by an operator for rapid removal thereof.

6. A head and face protecting apparatus comprising a helmet, a face shield attached to said helmet and a series of like thin transparent auxiliary lenses in a compact series of flexible transparent neighboring sheets attached to said face shield at horizontally spaced apart lateral portions of said sheets and comprising a series of internal sheets and a peripheral sheet, each sheet with a grasping ear portion; all said sheets except the peripheral one having its grasping ear portion elastically compressed between lateral portions of adjacent sheets, only the most peripheral of said series having its grasping ear portion extending laterally therefrom whereby it is selectively available for engagement by an operator for rapid removal thereof;

said lens being formed of a transparent relatively flexible yet dimensionally stable sheet comprised of a right or grasping ear portion, a central lens portion and a follower end portion, all joined together, and said lens having a grasping edge at one peripheral edge of the grasping ear portion of the lens; said grasping ear portion being continuous with and adjacent to the central lens portion which is continuous with the follower end portion which has a follower edge spaced from said grasping edge, the grasping ear portion having a first grasping ear hole, the rightward edge of the said grasping ear hole spaced away by a relatively small mass of the lens from the right hand or grasping edge of said lens, a straight fold located between the grasping ear portion of the lens and the central portion of the lens and said sheet is continuous across said fold and, spaced from said fold on a side opposite therof to said grasping edge there is located a second slotted grasping end fastener hole; and a third follower end portion slotted fastener hole is located in the follower end portion of the lens near to but spaced away from said follower end edge of the lens, and said second and third holes are spaced apart from each other, a plurality of slits extend radially from the edge of the third follower end fastener hole into the sheet forming the central lens portion, said shield having firmly attached thereto laterally extending shafts with terminal expanded ends thereon, each one of said second and third holes in each of said lenses attached to one of said shafts and the smallest diameter of said first hole is greater than the diameter at the expended end of one of said shafts and the diameter of said second hole is smaller than the diameter at the expended end of said one of said shafts and is attached to said shaft between said end and said shield.

7. Apparatus as in claim 6 wherein the centers of said first and second and third holes lie in the same straight line and slits extend at an angle to said line.

8. Apparatus as in claim 7 wherein the diameters of the second and third holes are the same size.

9. A face shield protecting apparatus comprising a series of like thin transparent auxiliary lenses in a compact series of adjacent flexible transparent neighboring sheets where each said lens is formed of a transparent flexible yet dimensionally stable sheet comprised of a right or grasping ear portion, a central lens portion and a follower end portion, all serially joined together, and said lens has a grasping edge at one peripheral edge of the grasping ear portion of the lens; said grasping ear portion being continuous with and adjacent to the central lens portion which is continuous with the follower end portion which has a follower edge spaced from said grasping edge, the grasping ear portion having a first circular grasping ear hole, the rightward edge of the said grasping ear hole spaced away by a relatively small mass of the lens from the right or grasping edge of said lens, and spaced from said grasping edge hole there is located a second slotted circular grasping end fastener hole; and a third circular follower end portion slotted fastener hole is located in the follower end portion of the lens near to but spaced away from said follower edge of the lens, said second and third holes spaces apart from each other, and at least one slit extends radially from the edge of the third follower end fastener hole into the sheet forming the central lens portion and, the centers of said first and second and third holes lie in the same straight line, and the diameter of the second and third holes are the same size.

10. Apparatus as in claim 9 wherein a straight permanent fold extends transversely to said line and said fold is located between the grasping ear portion of the lens and the central portion of the lens and said sheet is continuous across said fold and, said fold is located midway between the centers of said first and second holes.

11. For use in conjunction with a face shield having spaced apart projections extending therefrom, a series of adjacent auxiliary lens each comprising:

an elongate, unitary body of thin, flexible, dimensionally stable, transparent plastic material defining a grasping ear portion extending to a central lens portion extending to a follower end portion;

said grasping ear portion having a grasping hole formed therethrough;

said central lens portion having a projection receiving hole formed therethrough in the region adjacent the grasping ear hole for receiving one of the projections of the face shield and thereby securing one end of the lens to the face shield, and said follower end portion having a projection receiving hole formed therethrough for receiving the other projection of the face shield and thereby securing the other end of the lens to the face shield said grasping hole in said grasping ear portion and the projection receiving hole in said central lens portion of each underlying auxiliary lens being adapted to simultaneously receive one of the projections of the face shield.

12. The apparatus according to claim 11 further characterized by the projection receiving holes of a second lens receiving the projections of the face shield and with the grasping hole of the second lens also receiving one of the projections so that the grasping ear of the second lens is retained in a folded condition by the first auxiliary lens.

* * * * *

UNITED STATES PATENT AND TRADEMARK OFFICE

CERTIFICATE OF CORRECTION

PATENT NO. : 4,138,746

DATED : February 13, 1979

INVENTOR(S) : Donald W. Bergmann

It is certified that error appears in the above-identified patent and that said Letters Patent are hereby corrected as shown below:

Column 7, line 31, after "has" insert --a--.
Column 8, line 7 change "and" to --the--.
Column 8, line 47 change "holes" to --hole--.
Column 10,line 14 change "portions" to --portion--.
Column 10, line 24 after "portion" delete "being".
Column 11, line 66, insert --the-- after "and".
Column 12, line 43 after "ear" delete "portion".

Signed and Sealed this

*Twenty-eighth* Day of *August 1979*

[SEAL]

*Attest:*

*Attesting Officer*

LUTRELLE F. PARKER

*Acting Commissioner of Patents and Trademarks*